United States Patent [19]

DeYoung

[11] Patent Number: 4,988,417

[45] Date of Patent: Jan. 29, 1991

[54] PRODUCTION OF LITHIUM BY DIRECT ELECTROLYSIS OF LITHIUM CARBONATE

[75] Inventor: David H. DeYoung, Export, Pa.

[73] Assignee: Aluminum Company of America, Pittsburgh, Pa.

[21] Appl. No.: 291,527

[22] Filed: Dec. 29, 1988

[51] Int. Cl.[5] ..... C25C 3/02; C25C 7/00; C25C 7/04

[52] U.S. Cl. ..... 204/68; 204/243 R; 204/245; 204/246; 204/292; 204/294; 204/295

[58] Field of Search ..... 204/68, 243 R, 245-247, 204/295, 292, 294

[56] References Cited

U.S. PATENT DOCUMENTS

| | | | |
|---|---|---|---|
| 590,826 | 9/1897 | Darling | 204/290 |
| 641,276 | 1/1900 | Darling | 204/243 R |
| 1,901,407 | 3/1933 | Osborg | 204/71 |
| 3,002,905 | 10/1961 | Brenner et al. | 204/64 T |
| 3,248,311 | 4/1966 | Wood | 204/68 |
| 3,344,049 | 9/1967 | Thieler | 204/68 |
| 3,479,274 | 11/1969 | Bott | 204/260 |
| 3,539,394 | 11/1970 | Arrance | 429/219 |
| 3,560,263 | 2/1971 | Swinkels | 429/3 |
| 3,607,413 | 9/1971 | Buzzelli | 204/39 |
| 3,645,792 | 2/1972 | Hacha | 429/112 |
| 4,054,678 | 11/1977 | Walker, Jr. | 426/653 |
| 4,139,428 | 2/1979 | Dean et al. | 204/68 |
| 4,200,686 | 4/1980 | Fletcher | 429/112 |
| 4,405,416 | 9/1983 | Raistrick et al. | 204/68 |
| 4,455,202 | 6/1984 | Sintim-Damoa et al. | 204/68 |
| 4,521,284 | 6/1985 | Tanabe et al. | 204/71 |
| 4,533,442 | 8/1985 | Neelameegham et al. | 204/68 |
| 4,617,098 | 10/1986 | Verdier et al. | 204/68 |
| 4,680,101 | 7/1987 | Darlington et al. | 204/298 |
| 4,740,279 | 4/1988 | Müller et al. | 204/245 X |
| 4,804,448 | 2/1989 | Sammells et al. | 204/68 X |

FOREIGN PATENT DOCUMENTS 1024689 3/1966 United Kingdom .

OTHER PUBLICATIONS

R. Gee and D. J. Fray, "Refining of Gallium Using Gallium Beta-Alumina," *Electrochimica Acta*, vol. 24, pp. 765-767, (1979).

R. S. Gordon, "Electrorefining of Sodium Using Solid State Rapid Ion Conductors," Phase 1 Final Report for the Period, Sep. 1, 1980 to Feb. 28, 1981, Under Grant No. DAR-8009646, National Science Foundation SBIR, (1981).

Mahl et al., Journal of Metals, vol. 38, No. 16, pp. 20-26, (1986), "Lithium-Metal of the Future."

*Primary Examiner*—Donald R. Valentine

*Attorney, Agent, or Firm*—Douglas G. Glantz; Arnold B. Silverman

[57] ABSTRACT

A method of electrolytically producing lithium includes providing an electrolytic cell having an anode compartment and a cathode compartment. The compartments are separated by a porous electrically nonconductive membrane which will be wetted by the electrolyte and permit migration of lithium ions therethrough. Lithium carbonate is introduced into the anode compartment and produces delivery of lithium ions from the anode compartment to the cathode compartment where such ions are converted into lithium metal. The membrane is preferably a non-glass oxide membrane such as a magnesium oxide membrane. The membrane serves to resist undesired backflow of the lithium from the cathode compartment through the membrane into the anode compartment. Undesired communication between the anode and cathode is further resisted by separating the air spaces thereover. This may be accomplished by applying an inert gas purge and a positive pressure in the cathode compartment.

The apparatus preferably includes an electrolytic cell with an anode compartment and a cathode compartment and an electrically nonconductive membrane which is wettable by the electrolyte and will permit migration of the lithium ion therethrough while resisting reverse passage of lithium therethrough.

24 Claims, 2 Drawing Sheets

PRODUCTION OF LITHIUM BY DIRECT ELECTROLYSIS OF LITHIUM CARBONATE

BACKGROUND OF THE INVENTION

1. Field of the Invention

The present invention relates to a method and associated apparatus for the production of lithium by direct electrolysis of lithium carbonate and, more specifically, it relates to such a system employing an improved barrier member.

2. Description of the Prior Art

The demand for lithium has increased substantially over the years. It is anticipated that large quantities of the material will be needed for such uses as batteries and aircraft alloys, for example. Both of these uses are expected to require large quantities of pure lithium metal and new techniques for providing the metal will be needed.

It has been known to produce lithium through the electrolysis of lithium-containing fused salts. See generally, U.S. Pat. Nos. 3,560,263; 4,139,428; 4,200,686; 4,405,416; 4,533,442; and 4,617,098.

It has been known to produce metallic lithium on a commercial basis through the electrolysis of lithium chloride which has been produced from lithium carbonate. In the production of lithium chloride from spodumene, the major domestic raw material for the production of lithium, lithium carbonate is an intermediate product. See generally, Mahi et al., Journal of Metals, Vol. 38, No. 11, pp. 20–26 (1986). Among the problems with this approach have been the corrosion of equipment in the recycling of chlorine gas and the relatively high cost of producing lithium chloride from lithium carbonate.

United Kingdom Patent No. 1,024,689 discloses a fused salt electrolysis process for preparing lithium from lithium carbonate. The lithium carbonate is charged to an anode compartment wherein it reacts with gaseous chlorine This produces lithium chloride which is used to produce lithium. See, also, U.S. Pat. No. 3,344,049.

U.S. Pat. No. 4,455,202 discloses a process for producing lithium from lithium-containing compounds including lithium carbonate by electrolysis. The lithium is reduced into a liquid metal cathode to form an alloy. The alloy may subsequently be used to produce lithium.

It has been suggested to produce lithium by direct electrolysis of lithium carbonate through efforts to separate lithium from the carbonate by use of a liquid metal bi-polar electrode. Unfortunately, such efforts did not provide effective means for resisting undesired reactions between the lithium and dissolved lithium carbonate in the cathode to form lithium oxide and elemental carbon.

It has also been known to employ separators in fused salt electrolysis or similar processes. See generally, U.S. Pat. Nos. 590,826; 641,276; 3,248,311; 3,479,274; 3,539,394; 3,645,792; 4,054,678; and 4,680,101.

U.S. Pat. Nos. 590,826 and 641,276 describe diaphragms with little guidance as to specific end uses except for general electrolysis of hydroxides, nitrates or sulfates. There is disclosed a mechanical arrangement wherein packed powder which consists of vitreous oxides is contained between porous screens with the entire assembly acting as a diaphragm.

In spite of these prior art teachings there remains a very real and substantial need for an effective means for the production of lithium by direct electrolysis of lithium carbonate.

SUMMARY OF THE INVENTION

The present invention has solved the above-described problems by providing a method and associated apparatus for the direct electrolytic production of lithium from lithium carbonate.

In its broader aspects, the method includes providing an electrolytic cell having an anode compartment and a cathode compartment, and separating the compartments with a porous, electrically nonconductive membrane. The membrane preferably is such that it will be wetted by the electrolytes and permit migration of lithium ions therethrough. Lithium carbonate is introduced into the anode compartment and delivery of lithium ions from the anode compartment to the cathode compartment is effected with the lithium ions being converted into lithium within the cathode compartment. The lithium carbonate is perferably introduced into the anode in an amount of about 0.5 to 10 percent (by weight) of the anolyte.

It is preferred to employ a membrane which is a non-glass oxide membrane such as a magnesium oxide membrane. The membrane serves to resist diffusion of carbonate therethrough while permitting migration of lithium ions therethrough.

It is preferred to establish a barrier between the two cells such as by providing an argon layer over the cathode compartment.

The apparatus includes a cell having an anode compartment, a cathode compartment and a separator of the type described hereinbefore.

It is an object of the present invention to provide an economically effective and efficient system for the production of lithium by a direct electrolysis of lithium carbonate.

It is a further object of this invention to provide such a system having a process and apparatus which resist undesired backflow of lithium from the cathode compartment to the anode compartment and thereby resist undesired recombination of the lithium and carbonate.

It is a further object of the present invention to provide such a system which is economically advantageous and efficient.

It is a further object of the present invention to produce commercially pure lithium directly from lithium carbonate.

It is a further object of the invention to provide such a system which has high current efficiency and high yield of lithium.

These and other objects of the invention will be more fully understood from the following description of the invention on reference to the illustrations appended hereto.

DESCRIPTION OF THE PREFERRED EMBODIMENTS

Figure 1:
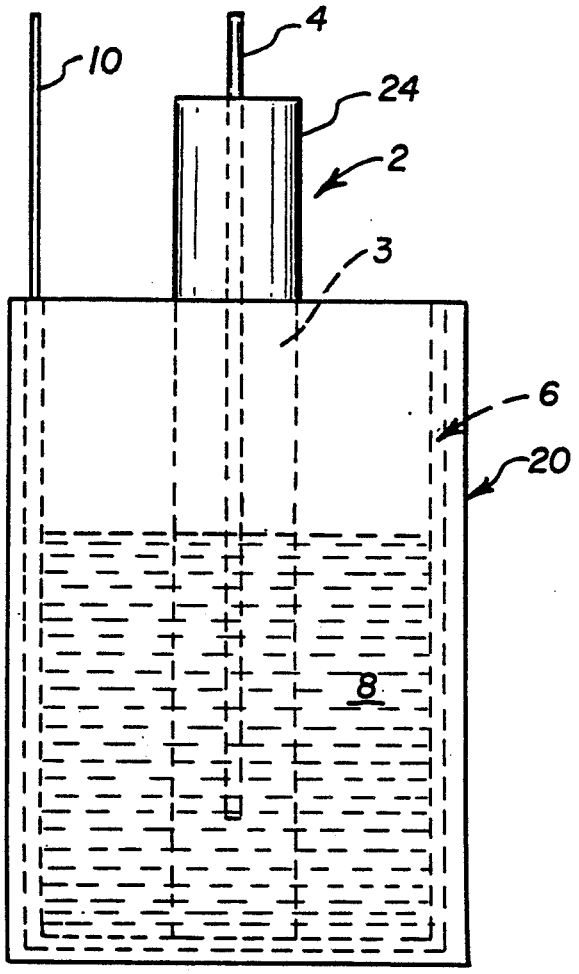
FIG. 1 is a schematic illustration of a form of apparatus of the present invention.

As used herein, in the absence of an express indication to the contrary, the term "high purity lithium" shall mean lithium being of at least 99% purity.

Referring again to FIG. 1 there is shown schematically a form of apparatus which may advantageously be employed in the present invention. In this embodiment, the inner container 2 defines cathode compartment 3 which is generally upwardly open and is preferably made from a porous electrically nonconductive membrane.

The membrane is preferably composed of a non-glass oxide material such as magnesium oxide. The material is such that it will permit migration of lithium ions from the exterior of the cathode defining compartment 2 to the interior thereof while resisting undesired transport of carbonate therethrough except the relatively slow diffusion method. The material is generally chemically stable in contact with molten lithium and wettable by the electrolytes employed in the cell. The barrier membrane generally has a porosity of about 2 to 70 percent and preferably about 5 to 48 percent and is electrically nonconductive, but wettable by the electrolytes thereby permitting conduction of the lithium $Li^+$ion therethrough from the anode compartment 8 into the cathode compartment 3. The porous membrane, while wetted by the molten salt electrolyte is not wetted by molten lithium.

In the form illustrated, the cathode is a rod 4, which may be composed of stainless steel, for example. It is suspended generally axially centrally within the cathode compartment 3. The rod 4 should be composed of a material which is chemically stable in contact with lithium.

The anode 6 in the form illustrated has a generally cylindrical configuration. The upwardly open container defines anode compartment 8. The anode 6 may be a graphite crucible within which the container 2 is received. The diameter of the anode 6 is substantially larger than the cathode compartment defining container 2. In order to feed current to the anode and to monitor the voltage across the cell, an electrical lead 10 is secured to the anode 6. The voltage may be measured across the cathode 4 and anode lead 10.

In practicing the invention, an anolyte such as lithium chloride (LiCl), for example, is introduced within the anode compartment 8. The anolyte generally will be any Salt LiX, where LiX is a compound which has a decomposition potential ($E_o$) that is greater than the decomposition potential for $Li_2CO_3$ and is a compound that has some solubility for $Li_2CO_3$. Solutions containing a number of compounds such as LiX, LiY, and LiZ can be used as anolyte with each compound having an $E_o$ as described herein and the solution has some solubility for LiX. Among the suitable LiX compounds are LiCl, LiBr and LiI. Salts of other cations such as potassium (for example, KCl) may be added to the anolyte, as long as their $E_o$ values are greater than that of $Li_2CO_3$ and LiX and the resulting anolyte has some solubility for $Li_2CO_3$. Due to the electrical migration of the cations toward the cathode, the concentration of the non-lithium salts in the anolyte will gradually be reduced with cell operation to a relatively low concentration at which electrical migration of the cations from the anolyte to the catholyte will be balanced by the chemical diffusion of this species from the catholyte to the anolyte.

The catholyte may be any salt AY which has a decomposition potential E that is greater than the $E_o$ for LiY and which has some solubility for LiY. Solutions of a number of compounds such as AY, BY, CY, AX, AZ, BX, BZ and the like may be employed provided that the decomposition potentials of each of the salts is greater than the decomposition potential of the corresponding lithium salt such as LiX, LiY, LiZ.

It is preferred but not essential that the ionic component of the anolyte be the same as the anionic component of the catholyte. For example, if LiCl is used as the anolyte, the catholyte should contain a compound or solution of compounds from the group ACl, BCl and the like. This serves to resist changes in the compositions of the electrolyte during electrolysis that would result from electrical migration.

The catholyte which may consist of lithium chloride (LiCl) and potassium chloride (KCl) is introduced into cathode compartment 3. It is preferred that the lithium chloride and potassium chloride be provided, respectively, on a weight percentage basis of total catholyte being about 100 to 22 percent lithium chloride and about 0 to 78 percent potassium chloride.

It is generally desirable to add a small amount of fluorine ion to the electrolytes, preferably in the form of lithium fluoride (LiF). This component increases the contact angle of metallic lithium, thereby resisting any tendency for lithium to wet the porous membrane. This increases the current efficiency and yield of the cell. The concentration of fluoride in the form of a salt generally will range from about 0.1 to 100 weight percent (excluding carbonate added as feed) although it is preferable to maintain it within the range of about 1 to 10 percent.

In practicing the invention, lithium carbonate ($Li_2CO_3$) is introduced into the anolyte which is disposed and dissolved within the anode compartment 8. It is preferred that the lithium carbonate being introduced in an amount of about 0.5 to 10 percent on a weight basis of the anolyte. The lithium carbonate may be introduced in any desired form such as a slug or in powder form, for example.

The lithium carbonate is electrolyzed to produce lithium and carbon dioxide when the anode is a carbon such as graphite anode 6. The $Li^+$ion migrates from the anode compartment 8 through the porous barrier or membrane of cathode container 2 into the cathode compartment 3 with the lithium being formed and the carbon dioxide being evolved.

As the decomposition voltage for pure lithium carbonate is about 1.85 volts and about 2.2 volts for a 1% lithium carbon- ate solution as compared with 3.46 volts for lithium chloride (LiCl) (all at 650 degrees C.), the energy requirements for operation of the cell of this invention are substantially less than for the lithium chloride approach.

As $Li_2CO_3$ is depleted in the cell, the cell voltage will tend to rise. As a result by monitoring the cell voltage one may obtain an indication of whether the $Li_2CO_3$ concentration in the anolyte is within the desired range.

In a preferred practice of the invention a stainless steel container 20 is disposed in surrounding relationship with respect to the anode 6. Also, a tubular sleeve 24, which preferably is of the same diameter as container 2, is secured to the upper extremity of porous membrane cathode container 2 to resist undesired entry of the carbon dioxide anode gas into the cathode compartment. If desired, argon, or other inert gases, under positive pressure may be provided in cathode compartment 3 to further resist undesired entry of carbon dioxide. A top closure (not shown) may be provided on sleeve 24 with an opening to permit passage of cathode rod 4 therethrough.

While the apparatus shown in FIG. 1 contains two concentric generally cylindrical anode and cathode containing compartments, anode 6 and cathode 2, it will be appreciated that any other desired configuration may be provided. For example, the cell may be of generally rectangular shape in plan, side elevation and end elevation with the barrier disposed within the center with a generally planar barrier disposed within the center and the anode positioned on one side thereof and the cathode on the other side thereof.

Figure 2:
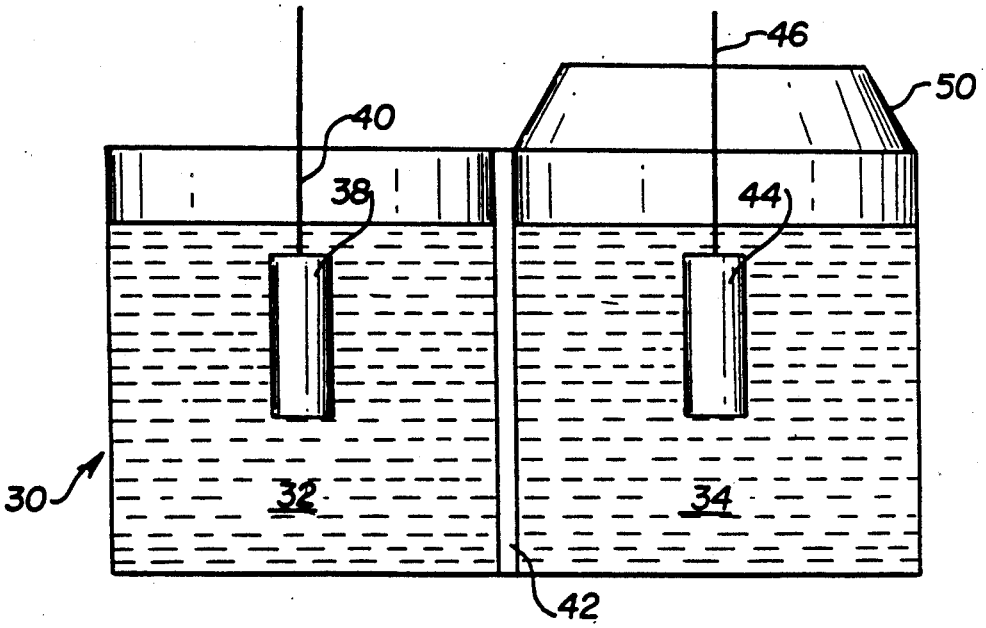
FIG. 2 is a schematic illustration of a modified form of apparatus of the present invention.

FIG. 2 shows such an alternate configuration for apparatus of the invention. In this form, a housing 30 has an anode compartment 32 and a cathode compartment 34. Anode 38 which may be a carbon anode, for example, is suspended within the anode compartment 32 by lead 40. The anolyte which may be LiCl is disposed within anode compartment 32. Porous inert ceramic barrier 42 which may be of the type described hereinbefore separates the two compartments. Cathode 44 may be composed of stainless steel and is supported by lead 46. Catholyte which may be a LiCl-KCL electrolyte is disposed within cathode compartment 34. A hood 50 overlies and seals the cathode compartment 34 while providing an opening for lead 46 to pass through. This serves to separate the headspaces over the two compartments 32, 34

The cell may be operated at an electrolyte temperature of 550 to 770 degrees C. and preferably at 605 to 700 degrees C. The preferred cell voltage measured between cathode 4 and anode 6 is about 1.85 to 10 volts.

The following reactions occur within the anode:

$$2CO_3^{2-}C \rightarrow 3 + CO_2 + 4e^- \quad (1)$$

The following reactions occur within the cathode:

$$4Li^+ + 4e^- 4Li \quad (2)$$

In the preferred practice of the invention pure lithium will be produced. An example of the sort of composition which might be encountered is lithium being present in an amount in excess of about 99.5%. Impurities may include sodium in an amount of less than about 0.10%, calcium in an amount of about 0.02% or less and magnesium in an amount of 0.35% or less, and aluminum in an amount of 0.05% or less. The composition of lithium will depend on the composition of the lithium carbonate.

The undesired back/reaction of Li can produce the reaction $Li + Li_2CO_3 \rightarrow 3Li_2O + C$. As lithium oxide and carbon are essentially insoluble in lithium chloride or other halide salts, sludge would tend to be produced within the electrolyte.

In order to verify the effectiveness of the invention, a series of experiments were performed. The equipment shown in FIG. 1 was employed. Lithium carbonate was fed to the anode compartment 8 in powder form before and during electrolysis. An argon purge was established within the upper portion of the cathode compartment. Oxygen was removed from the argon prior to introduction into the cathode compartment. During the test, cell current was maintained at various levels ranging from about 0 to 50 amps.

Employing this system current efficiencies as high as 93% were achieved and yields were near 100%. In one test the cell temperature was maintained at about 550 degrees Centigrade and the nominal current was at 30 amps for a portion of the test, and 40 amps for another portion of the test. Electrolysis was carried out for 7.22 hours and the total electrical charge passed through the cell was 121.07 amp hours. In this test 29.21 grams of pure lithium metal were recovered. A current efficiency of 93.2 was calculated from this data. The yield was 105.3%. The yield was greater than 100% because during some portions of the test the cell was purposely allowed to become depleted in $Li_2CO_3$, and as a consequence lithium was produced on consumption of LiCl from the electrolyte. In another test, the cell temperature was maintained at 650 degrees C. The nominal current was 30 amps and 40 amps and the electrolysis time was 6.05 hours. The total charge in amp hours was 140.26. The process resulted in pure lithium metal recovery of 32.36 grams with the system having operated at a current efficiency of 89.09%. The yield was 99.3%.

Table 1 sets forth elemental analysis of lithium metal that was produced in several tests employing the process of this invention. The major impurity was magnesium which comes from the MgO porous membrane employed in the test. This table confirms the production of lithium having a purity of greater than 99.5%.

TABLE 1

Composition of Lithium Produced by Direct Electrolysis of Lithium Carbonate

| Experiment | Al | Ca | Mg | Na |
|---|---|---|---|---|
| A | 0.05 | 0.02 | 0.35 | 0.04 |
| B | <0.01 | 0.02 | 0.15 | 0.07 |
| C | 0.03 | 0.02 | 0.31 | 0.05 |

Figure 3:
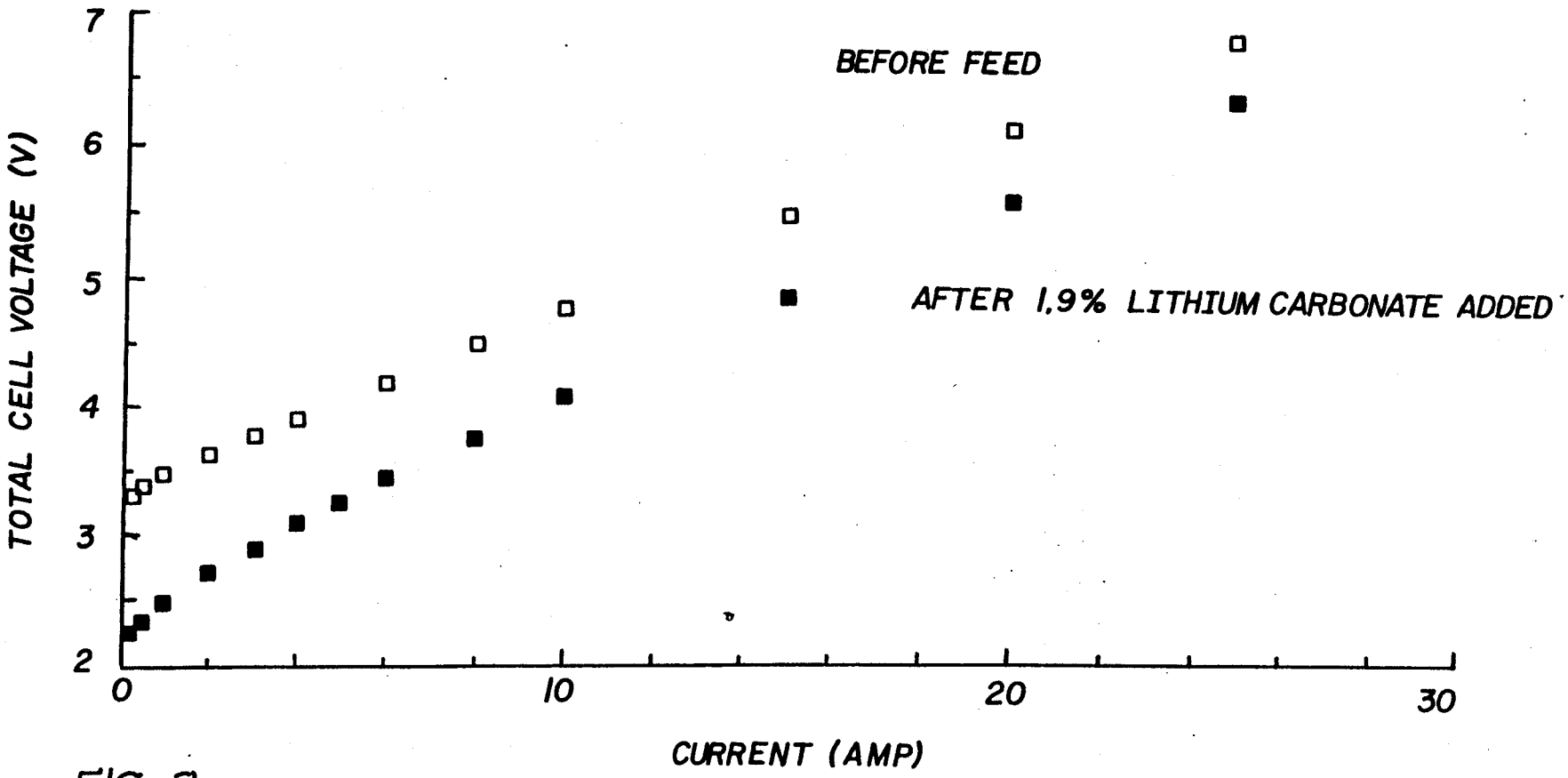
FIG. 3 is a plot of cell voltage as a function of current under different feed conditions.

When the cell was electrolyzing lithium carbonate, the interrupt voltage, or voltage immediately after the cell current was shut off, was approximately 2.2 volts. This is consistent with the overall cell reaction $$2Li_2CO_3 + C = {}_2CO_3\, 4Li + 3CO_2$$

which has a thermodynamic decomposition voltage of 1.85 volts. The value of 1.85 volts is for the situation where the activity of $Li_2CO_3$ is unity i.e. some $Li_2CO_3$ is being electrolyzed. The increase in decomposition voltage is consistent with the reduced thermodynamic activity of lithium carbonate in the approximately 1% solution. When the concentration of lithium carbonate was intentionally allowed to become depleted i.e. the electrolysis was continued without any addition of lithium carbonate to the anolyte, the cell voltage rose and chlorine gas was produced at the anode. The cell voltage at zero current was approximately 3.3 volts, which corresponds well with the thermodynamic decomposition voltage for pure LiCl of 3.46 at 650 degrees C. After an addition of $Li_2CO_3$ was made to the anolyte, the cell voltage decreased and chlorine production at the anode ceased. FIG. 3 is a plot of cell voltage as a function of cell current, before and after the cell was fed with $Li_2CO_3$ with the hollow squares showing the values before feed and the solid blocks showing the values after feed. The reduced voltage at a given current level after feed is clearly shown.

These results demonstrate that the cell does not make chlorine gas which then chemically reacts with the lithium carbonate. If this were so the cell voltage at zero current would be at least as high as the decomposition voltage for lithium chloride, approximately 3.46 volts at 650 degrees C. The value of the cell voltage at zero current of approximately 2.2 volts demonstrates that $Li_2CO_3$ is being directly electrolyzed.

For comparative purposes, an experiment was performed in which no porous membrane was employed. The anode and cathode were not separated by a barrier and the composition of the electrolyte was (by weight percent) 95% LiCl, 5% $Li_2CO_3$. The nominal cell current was 12 amps, the electrolysis time was 5.25 hours and the total charge passed through the cell was 56.03 amp hours. Only 0.71 grams of pure metallic lithium was recovered, thereby giving a current efficiency of 4.9% and a yield of 5.8%. The test electrolyte contained a black sludge, which was found by analysis to be $Li_2CO_3$ and C. A comparison of these results of the previous two tests described hereinbefore demonstrates the effectiveness of separating the product lithium from the lithium carbonate feed.

It will be appreciated therefore, that the present invention provides a method and associated apparatus for efficient production of lithium by direct electrolysis of lithium carbonate. This is accomplished at a high current efficiency, with low energy requirements and produces a high yield of pure lithium. The use of the unique barrier member facilitates migration of the lithium ions from the anode compartment to the cathode compartment while resisting undesired back reactions.

While for simplicity of disclosure certain shapes of cells have been discussed it will be appreciated that the invention is not so limited and numerous other configurations will be apparent to those skilled in the art.

Whereas particular embodiments of the invention have been described above for purposes of illustration it will be appreciated by those skilled in the art that numerous variations of the details may be made without departing from the invention as set forth in the appended claims.

I claim:

1. A method of electrolytically producing lithium comprising providing an electrolytic cell having an anode compartment and a cathode compartment, each containing fused salt electrolytes, separating said compartments with a porous electrically nonconductive membrane which will be wetted by said electrolytes and permit migration of lithium ions therethrough, introducing lithium carbonate into said anode compartment and dissolving said lithium carbonate in the electrolyte contained in said anode compartment, electrolyzing said lithium carbonate, delivering lithium ions from said anode compartment to said cathode compartment, during said delivery of said lithium ions resisting diffusion of carbonate ions across said membrane from said anode compartment to said cathode compartment, and converting said lithium ions into lithium metal.

2. The method of claim 1 including providing said anode compartment electrolyte as a chloride anolyte.

3. The method of claim 2 including employing lithium chloride as said anolyte.

4. The method of claim 1 including employing as said membrane a non-glass oxide membrane.

5. The method of claim 4 including employing as said membrane a magnesium oxide membrane.

6. The method of claim 4 including resisting backflow of said lithium from said cathode compartment through said membrane into said anode compartment.

7. The method of claim 4 including separating the head space over said electrolyte in said cathode compartment from said anode compartment to resist entry of carbon dioxide into said cathode compartment.

8. The method of claim 4 including establishing an inert gas purge at a positive pressure in said cathode compartment.

9. The method of claim 4 including employing as said cathode compartment electrolyte a catholyte having a mixture of lithium chloride and potassium chloride.

10. The method of claim 9 including providing said lithium chloride in an amount of about 100 to 22 weight percent of said catholyte, and providing said potassium chloride in an amount of about 0 to 78 weight percent of said catholyte.

11. The method of claim 4 including performing said process at an electrolyte temperature of about 550 to 700 degrees C.

12. The method of claim 11 including maintaining the voltage in said cell at about 1.85 to 10 volts measured between said anode and cathode.

13. The method of claim 12 including resisting migration of carbonate anions through said membrane while permitting diffusion of lithium cations through said membrane.

14. The method of claim 13 including employing a carbonaceous material as said anode.

15. The method of claim 14 including employing a graphite anode.

16. The method of claim 14 including employing a stainless steel cathode or cathode lead.

17. The method of claim 4 including employing a membrane having a porosity of about 5 to 48 percent.

18. The method of claim 4 including producing high purity lithium by said process.

19. The method of claim 1 including providing said anode compartment electrolyte as a salt which has a decomposition potential that is greater than the decomposition potential for $Li_2CO_3$.

20. A method of electrolytically producing lithium comprising providing an electrolytic cell having an anode compartment and a cathode compartment, each containing fused salt electrolytes, separating said compartments with a porous electrically nonconductive membrane which will be wetted by said electrolytes and permit migration of lithium ions therethrough, introducing lithium carbonate into said anode compartment, introducing into said anode compartment lithium carbonate in an amount of about 0.5 to 10 weight percent of the anolyte, delivering lithium ions from said anode compartment to said cathode compartment, and converting said lithium ions into lithium metal.

21. Apparatus for electrolytically producing lithium comprising cell having an anode compartment and a cathode compartment, an electrically nonconductive membrane separating said two compartments, and said membrane permitting migration of lithium ions therethrough while resisting diffusion of carbonate ions across said membrane from said anode compartment to said cathode compartment.

22. The apparatus of claim 21 including said membrane being a non-glass oxide material.

23. The apparatus of claim 22 including means for isolating the air space over one said compartment from the other said compartment.

24. The apparatus of claim 23 including employing a said membrane made of magnesium oxide.

* * * * *

UNITED STATES PATENT AND TRADEMARK OFFICE

CERTIFICATE OF CORRECTION

PATENT NO. : 4,988,417

DATED : January 29, 1991

INVENTOR(S) : DAVID H. DeYOUNG

It is certified that error appears in the above-identified patent and that said Letters Patent is hereby corrected as shown below:

Column 5, line 40, the equation should read:
-- $2CO_3^{2-} + C \rightarrow 3CO_2 + 4e^-$ --.

Column 5, line 44, the equation should read:
-- $4Li^+ + 4e^- \rightarrow 4Li$ --.

Claim 21, column 9, line 1, after "lithium", --from lithium carbonate-- should be inserted.

Signed and Sealed this

Thirteenth Day of April, 1993

*Attest:*

STEPHEN G. KUNIN

*Attesting Officer*

*Acting Commissioner of Patents and Trademarks*